US007735445B2

(12) United States Patent
Monk et al.

(10) Patent No.: US 7,735,445 B2
(45) Date of Patent: Jun. 15, 2010

(54) DEPLOYABLE MARKER BANNER STRUCTURE AND SYSTEM

(75) Inventors: Russell A. Monk, Salem, OR (US); Chad Jeremy Knowles, Wilsonville, OR (US); Albert M. Baker, Portland, OR (US)

(73) Assignee: High Impact Technology LLC, Tigard, OR (US)

( * ) Notice: Subject to any disclaimer, the term of this patent is extended or adjusted under 35 U.S.C. 154(b) by 698 days.

(21) Appl. No.: 11/712,246

(22) Filed: Feb. 27, 2007

(65) Prior Publication Data

US 2007/0199223 A1 Aug. 30, 2007

Related U.S. Application Data

(60) Provisional application No. 60/777,451, filed on Feb. 27, 2006.

(51) Int. Cl.
*G09F 17/00* (2006.01)

(52) U.S. Cl. ..... 116/209; 116/173

(58) Field of Classification Search ..... 116/209, 116/173–175, 28 R; 40/603–604
See application file for complete search history.

(56) References Cited

U.S. PATENT DOCUMENTS

| | | | | | |
|---|---|---|---|---|---|
| 2,342,773 | A | * | 2/1944 | Wellman | 114/261 |
| 2,715,231 | A | * | 8/1955 | Marston | 441/127 |
| 2,842,090 | A | | 4/1956 | Samwald | |
| 2,949,094 | A | * | 8/1960 | Clothier | 116/209 |
| 3,002,490 | A | | 10/1961 | Murray | |
| 3,007,437 | A | * | 11/1961 | Adair | 116/209 |
| 3,815,412 | A | * | 6/1974 | Keim | 73/170.03 |
| 3,877,096 | A | | 4/1975 | Scesney | |
| 3,952,694 | A | * | 4/1976 | McDonald | 116/209 |
| 4,809,638 | A | | 3/1989 | Kolesar et al. | |
| 5,398,437 | A | * | 3/1995 | Bump et al. | 40/582 |
| 5,421,287 | A | * | 6/1995 | Yonover | 116/209 |
| 6,415,734 | B1 | * | 7/2002 | LaPuzza | 116/201 |
| 6,505,575 | B1 | * | 1/2003 | Ciari | 116/209 |
| 7,530,873 | B1 | * | 5/2009 | Chang | 441/89 |

FOREIGN PATENT DOCUMENTS

| | | |
|---|---|---|
| AU | 58668 | 1/1975 |
| JP | 5-319375 | 12/1993 |

* cited by examiner

*Primary Examiner*—R. A. Smith
*Assistant Examiner*—Tania C Courson
(74) *Attorney, Agent, or Firm*—Jon M. Dickinson, PC; Robert D. Varitz, PC

(57) ABSTRACT

A deployable marker banner structure and system including (a) an elongate, rollable/unrollable fabric body having opposite ends, a long axis, and opposite faces, (b) shape-forming biasing structure operatively connected to the body, applying shape-forming biasing forces thereto at plural, spaced locations distributed along the body's long axis in a manner whereby, with the body unrolled, the biasing structure produces complex, alternating, longitudinally distributed convex and concave topography portions in the body's faces, with at least one each of such convex and concave topography portions disposed in each face of the body, and with each convex topography portion in one face of the body corresponding, and being complementary, to a companion concave topography portion located directly in the opposite face of the body, and (c) facial visibility-enhancing structure operatively present at least on the convex topography portions in the body's faces, urged by the mentioned topography portions into complex convex curvatures.

8 Claims, 2 Drawing Sheets

DEPLOYABLE MARKER BANNER STRUCTURE AND SYSTEM

CROSS REFERENCE TO RELATED APPLICATION

This application claims priority to prior-filed, currently co-pending U.S. Provisional Patent Application Ser. No. 60/777,451, filed Feb. 27, 2006, for "Deployable Marker Banner". The entire disclosure content of this Provisional Application is hereby incorporated herein by reference.

BACKGROUND AND SUMMARY OF THE INVENTION

This invention pertains to a deployable, streamer-like marker banner structure and system which may be attached to, or tossed onto, various surfaces, including water surfaces, for the purpose of enabling high-visibility locating near that surface of something, such as the position of a person or of a selected object, which is specifically marked by the marker.

Numerous situations exist wherein it is desirable, and in some circumstances critical, to place and use a high-visibility, remotely spottable marker to indicate, and in some instances to identify generally by category, the position of a person or of some object. For example, downed aviators on the ground or in the water, and specific objects which need to be located/identified for some purpose, come immediately to mind in this context.

A critical-use condition exists in the realm of marking dangerous devices, such as the so-called IED (Improvised Explosive Device) weapons currently employed by combatants in a Mideast war theatre.

Other illustrative uses involve hiker and climber rescues, the marking of helicopter landing zones, medivac operations, target marking, signals for needed roadside assistance, and many others.

In such situations, it is important that a marker of the kind just generally outlined, though typically relatively small in size as a practical matter, be structured to be readily and highly visible from as wide as possible a distribution of vantage points, including very low-angle vantage points. Such a marker is also one which preferably should be readily and easily deployable rapidly, and if carried as an emergency location device, or for other purposes, by a person, be conveniently stowable and carryable in a very compact form.

The present invention offers such a marker structure and system.

In accordance with a preferred embodiment of the invention, the proposed marker structure and system takes the form generally of an elongate, rollable/unrollable, fabric, streamer-like banner, one end of the elongate body in which may be, for certain applications, weighted with a suitably attached weight element, such as a magnetic weight element, and the other end of which may be unweighted. Such single-end weighting, and, where appropriate, magnetic weighting, enables easy throwing/tossing of the marker-banner device of the invention to aid in deployment and placement. In an application where the structure of the invention is to be deployed as a floating object on the surface of water, of course, no weighted end is present.

Provided preferably near, for example, the weighted end of the banner is an attaching structure, such as an open eyelet, which allows the banner easily to be attached to a particular surface for marking. Hook-and-pile structure (such as the product sold under the registered trademark VELCRO®) may also be provided for attaching an auxiliary identification marker, and for other purposes. An auxiliary marker may be provided which bears information useful for the specific purpose of identifying more specifically, for example, a particular kind of marked object.

The elongate fabric body of the banner structure of this invention, itself preferably made of a high-visibility material, is associated, by attachment, with a plurality of elongate, transverse, passive, elastomeric, shape-forming elements (ribbon-like in nature) which have been stitched to the body of the banner preferably under circumstances where they have been stretched, and thus under tension, during attachment. When these elastomer elements are relaxed after stitching, or after being otherwise attached to the mentioned fabric body, they are slightly pre-stressed because of their attachments to the banner body material which tends to resist full elastomeric contraction. Under these circumstances, they draw longitudinally inwardly on themselves toward relaxed-length conditions, also referred to herein as relaxed-condition lengths, to create, in cooperation with the banner body material, transverse material puckers, and arches which produce surface bulges in one direction from one side, or face, or the other, of the banner body. This condition thus creates in the banner body a kind of rising, convex elevation above any marked surface, which surface-bulge condition enables the marker banner to be seen quite readily from a substantial distance, even at very low observation angles. Preferably, these elastomeric elements, which are referred to herein collectively as shape-forming biasing structure, and also as shaping structure, are disposed on alternate, opposite sides, or faces, of the banner body material, in longitudinally spaced and distributed locations along that body material, whereby there are at least two regions of the body which tend to bulge outwardly, i.e., convexly, and longitudinally spaced, in opposite directions from opposite faces of the body.

A consequence, of course, of this unique arrangement, is that substantially no matter how the structure of the invention is deployed against a surface, and thus no matter which of its faces outwardly from that surface, at least a portion of the banner structure, along its length, exhibits a highly visible, outwardly-from-surface bulge, viewable easily from a distance. Thus, the plurality of distributed elastomeric shape-forming elements tends to create in the banner body a kind of undulating, serpentine, alternate-side bulge pattern as seen in a side-elevation of the banner body.

Preferably, along what might be thought of as the crests of bulges so produced, generally laterally centrally relative to the opposite lateral sides, or edges, in the banner body, there are suitably joined elongate strips of a highly reflective material, such as any suitable, conventional retro-reflective tape material. This material preferably is bonded by a heat-welding approach so as to operate effectively as a unit with the fabric that makes up the banner body. Bulges in the banner body tend to cause at least portions of such high-reflectance elements to bulge with complex, convex curvature, thus to be readily visible from extremely low angles.

The fabric body of the marker banner structure and system of this invention may be prepared with different colorings, singular or plural, in order to characterize it for use in marking particular kinds of things, and also to give it a high-visibility characteristic. Additionally, and preferably, attached to the opposite faces of the fabric body of the marker is something like one side of a conventional hook-and-pile attaching structure, which allows selective attachment to a selected side of the banner body of a secondary marker badge, or element. Such a badge may be differently colored, (or otherwise differently decorated) and formed also of a high-reflectance material, such as retro-reflective material, in order to collaborate with marker-body coloration to furnish an even "finer-grain" identification capability for something which is marked by the banner.

Still another interesting feature of the invention is that, with respect to the banner body being formed of a fabric material, when the device is not in use, it can be rolled up upon itself for very compact storage, and when tossed, preferably when it possesses a weighted end, will generally readily travel, in the direction in which it is thrown, in a "weight-forward" manner—i.e. in a manner which enhances the likelihood that a tossed/deployed marker banner will land and deploy substantially where desired.

These and other features and advantages of the marker banner structure/system of the present invention will become more readily apparent as the detailed description which now follows is read in conjunction with the accompanying drawings.

In certain ones of these figures, which are not drawn to scale, shading and cross-hatching surface marks have been employed to individuate and highlight certain structural elements present in the invention.

DETAILED DESCRIPTION OF THE INVENTION

Turning now to the drawings, indicated generally at 10, and illustrated in solid lines in an operative condition in FIGS. 1-5, inclusive, is a deployable marker banner structure and system which includes, as a central component, an elongate banner 12, and as a useful, augmentive structure, a secondary marker element also referred to herein as a secondary identification visibility marker, and as a patch, 14. Marker 14, which is detachably attachable and selectively so to banner 12, and which is useful to provide a certain level of specific, "finer-grain", marker-location identification, as will later be more fully explained, may be provided with a wide variety of user-selectable specific appearances, three representative ones of which are shown at 14*a*, 14*b*, 14*c* in FIG. 6. Banner 12 includes an elongate fabric body 12*a* having a central, long axis 12*b*, a user-selectable nominal overall length L (see FIG. 1), and a user-selectable, nominal, overall, lateral width W measured between opposite sides in body 12*a* (see also FIG. 1). Body 12*a* also possesses a pair of opposite ends 12*c*, 12*d*, and a pair of opposite faces 12*e*, 12*f*. Banner body 12*a* is illustrated in solid lines in FIGS. 1 and 2 in a fully deployed condition on a surface shown fragmentarily at 15 in FIG. 1, with its face 12*e* facing the viewer in FIG. 1 (upwardly in FIG. 2) and face 12*f* facing away from the viewer in FIG. 1 (toward surface 15 in FIG. 1, and downwardly in FIG. 2).

Figure 2:
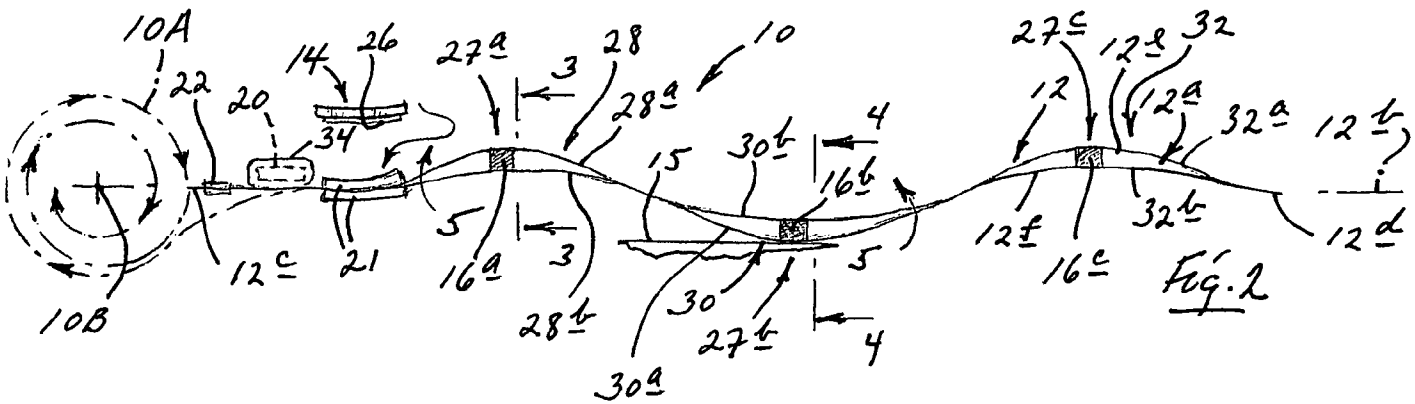
FIG. 2 is a simplified lateral elevation taken generally from the lower side of FIG. 1 with dash-dot lines being employed to aid in visualizing the "roll-up, roll-out" (rollable/unrollable) nature of the invention.

While different specific choices may be made regarding the construction and dimensioning of banner 12, banner body 12*a* may preferably be made of a sturdy, high-visibility, colorful fabric, such as colored 70-denier, polyurethane coated nylon fabric, with a nominal, overall length L (previously generally mentioned) of about 48-inches, and a nominal, overall lateral width W (also previously generally mentioned) of about 6-inches which is the same along substantially the entirety of the body's length. Colors found to be especially useful include lime yellow, vibrant orange, and neon pink. Banner body 12*a* is a rollable/unrollable, or roll-up/roll-out, structure, and in dashed lines at 10A in FIG. 2, is shown in a rolled-up condition conveniently compacted for stowage and carrying. What may be thought of as the "cylindrical" roll-up axis of structure 10 in this condition is shown at 10B.

Further included in banner structure and system 10, directly in operative association with banner body 12*a*, are (a) a passive, shape-forming structure 16 in the form of plural, elongate, pre-stressed, passive-action (passive) elastomeric strips, or shaping elements, 16*a*, 16*b*, 16*c*, (b) facial visibility enhancing structure 18 in the form of a pair of elongate, laterally central, retro-reflective tape strips 18*a*, 18*b* suitably joined, as by heat bonding, to opposite body faces 12*e*, 12*f*, respectively, (c) a weight element 20 disposed adjacent triangularly folded and formed body end 12*c*, and (d) an annular, open, metal grommet 22 which is also located adjacent the triangular apex portion of folded end 12*c*.

Also included in banner structure and system 10, one each on opposite banner-body faces 12*e*, 12*f*, is one portion 21, such as the "hook" portion, of conventional hook-and-pile structure of the type mentioned earlier herein. This hook-and-pile structure enables easy releasable attaching of secondary, or auxiliary, marker patches 14, the "non-high-visibility" sides of which are suitably equipped with the other, "pile" portion of hook-and-pile structure, such "other portions" being shown in dashed lines at 26 in certain ones of the drawing figures.

Figure 1:
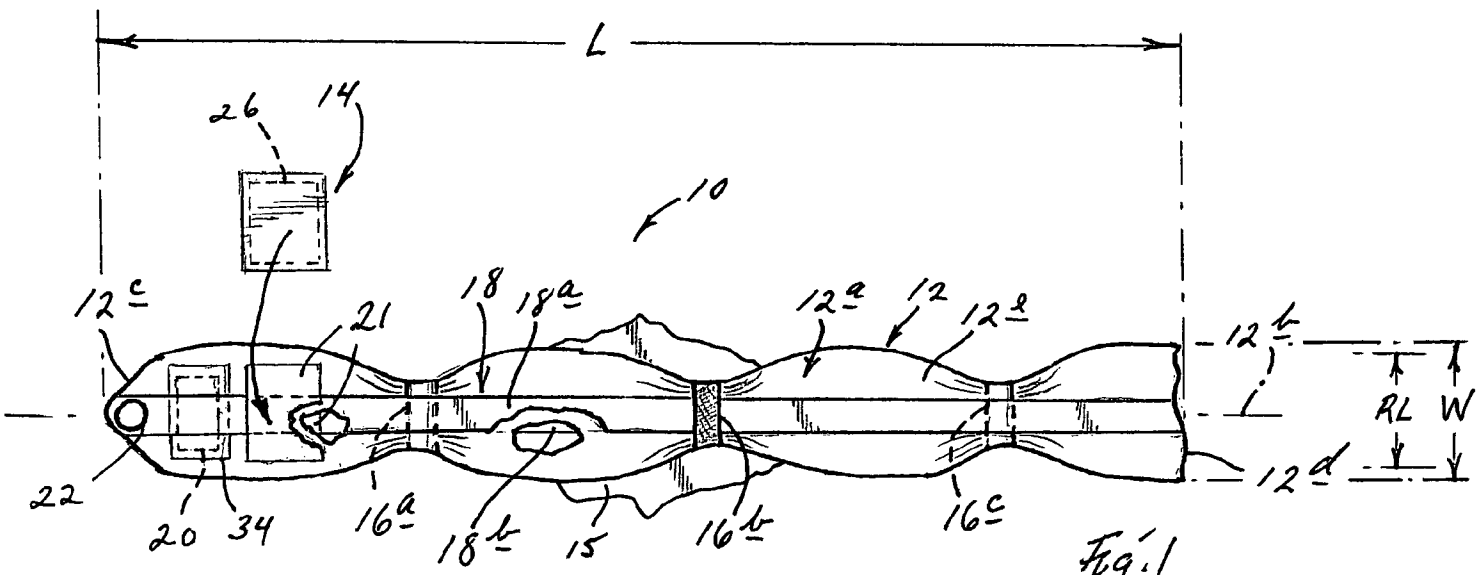
FIG. 1 is a plan view of one side, or face, of a marker banner structure and system constructed in accordance with the preferred and best-mode embodiment of the present invention.
Figure 3:
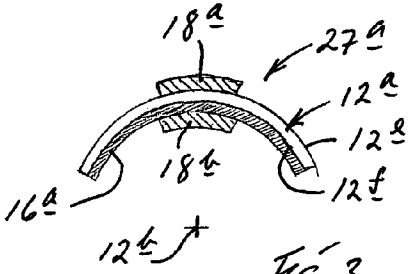
FIG. 3 is an enlarged, transverse cross section, somewhat simplified, taken generally along the line 3-3 in FIG. 2.
Figure 4:
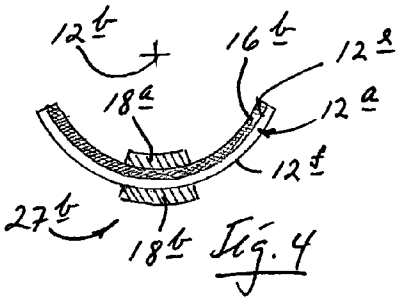
FIG. 4 is similar to FIG. 3, but taken generally along line 4-4 in FIG. 2.
Figure 5:
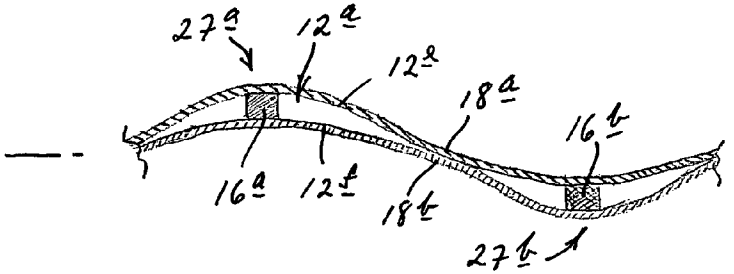
FIG. 5 is an enlarged, fragmentary and simplified view further illustrating the region in FIG. 2 which is bracketed by curved arrows 5-5.

Shaping elements 16*a*, 16*b*, 16*c* are formed of suitable elastomeric strips herein, each having a width of about 1-inches, and what is referred to herein for each such strip as its relaxed-condition length (RL) of about 5-inches (see FIG. 1). These elements which, in their relaxed states, are bowed into arcs, are spaced from one another along the length of banner body 12*a* by a distance herein of about 18-inches, with central strip 16*b* being located approximately longitudinally centrally between ends 12*c*, 12*d* of banner body 12*a*. Strips 16*a*, 16*c* are sewn onto banner-body side 12*f*, and strip 16*b* is sewn onto side 12*e*, in such manners that these strips have been tensed and "stretched" (i.e., unbent and straightened) to about 6-inches during sewing, whereby they each tend to contract toward their respective relaxed-condition lengths of about 5-inches to create the earlier-mentioned transverse lateral puckers (see FIG. 1) in banner body 12, as well as the illustrated, "reversely-disposed" arches 27*a*, 27*b*, 27*c* which are related, respectively, to strips 16*a*, 16*b*, 16*c*. FIGS. 3 and 4 illustrate arches 27*a*, 27*b*, respectively. In these conditions, the elastomer strips are in slightly stressed (tensed) conditions.

This arch-created condition which exists clearly wherever banner structure 10 is deployed, results in the important existence therein of three, longitudinally spaced, alternately oppositely, outwardly convexly directed, compoundly curved bulges 28, 30, 32 having convex sides 28*a*, 30*a*, 32*a*, respectively, and related, counterpart, concave sides 28*b*, 30*b*, 32*b*, respectively. Convex sides 28*a*, 30*a*, 32*a* exist on banner-body faces 12*e*, 12*f*, 12*e*, respectively, and concave sides 28*b*, 30*b*, 32*b* exist on banner-body faces 12*f*, 12*e*, 12*f*, respectively.

Weight element 20, which, as mentioned, may be a permanent magnet element, may conveniently be attached to end 12, on one face, such as face 12*e*, in banner body 12*a*, through a sturdy, "sewn-on", nylon jacket, such as that seen at 34. Such a jacket may be designed to provide for removal and insertion of a weight element, if desired, to deal with different marker-use situations.

Figure 6:
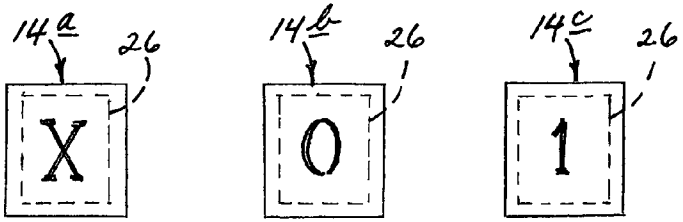
FIG. 6 illustrates, in plan views, marker-patch facial illustrations of several auxiliary marker patches, also referred to herein as secondary markers, which are selectively releasably attachable (as by hook-and-pile attaching structures partially illustrated in dashed lines) to opposite sides, or faces, of the main body structure of the invention pictured in FIGS. 1-5, inclusive.

Focusing attention now specifically on FIG. 6, representative, rectangular marker patches 14*a*, 14*b*, 14*c* may be made of substantially the same kind of high-visibility, colorful material as that used in banner body 12*a*. Specific additional marker indicia, such as "X" on one face in patch 14*a*, "O" on one face in patch 14*b*, and "I" on one face in patch 14*c* may be formed preferably of suitable retro-reflective tape like that discussed above herein.

These patches, as was suggested earlier, maybe removably attached to a marker banner body, such as to body 12*a*, through hook-and-pile attaching structure, such as that previously mentioned, and illustrated at 21, 26 in the drawings.

These patches function in an auxiliary manner to furnish categories of "fine-grain" identification of a marked person, surface, or device. The patches may take on a variety of different shapes, and may feature a variety of different, specific marker indicia.

As is apparent, the marker structure of this invention is easily carried in a compact, rolled-up condition (see 10A). It may be equipped with a weight element as an aid for user-tossing deployment, or it may either be furnished without such an element per se "in place", but readily installable in an openable, closeable jacket, as mentioned earlier.

Without an attached weight element, the banner marker structure may be easily water-surface or ground-surface deployed as one wishes. Grommet 22 may, if desired, be used appropriately for surface-attaching purposes, and, of course, other attaching modalities not specifically discussed herein may also be employed.

On all surfaces, and given the preferred construction of structure 10, there will always be at least one convex bulge which projects outwardly from that surface to promote high visibility even from low viewing angles relative to a marked surface.

Accordingly, a preferred and best mode embodiment of the invention, and certain modifications thereof, have been illustrated and/or described herein. Those generally skilled in the relevant art may well appreciate that various other modifications of the invention may be made without departing from the spirit of the invention, and we intend that the claims to invention herein will cover all such other modifications.

We claim:

1. A deployable marker banner comprising an elongate fabric banner body having opposite faces, laterally opposite sides, and a central, long axis, shape-forming structure including plural, spaced, elongate shaping elements operatively attached to, and distributed along the length of, said body, each said element, in the deployed and operative condition of the banner, being bowed into an arc along its length, and extending generally transversely relative to said banner body's said long axis, with alternate elements, as distributed along the length of said body, curving convexly outwardly in opposite directions from, and relative to, said axis, thereby to produce complex, alternating, longitudinally distributed, compoundly curved, convex and concave, bulging topography portions in the opposite faces of said body, with each convex topography portion in one face of the body corresponding, and being complementary, to a companion, concave topography portion located directly in the opposite face of the body, and facial visibility-enhancing structure operatively present at least on the convex topography portions in the faces of said body, urged by said topography portions into complex, compound, convex curvatures.

2. The structure and system of claim 1, wherein said shaping elements take the forms of elastomeric strips anchored alternately to opposite faces in said body.

3. The structure and system of claim 2, wherein said body, at the location of each elastomeric strip, has a nominal width, and the elastomer strip at that location has an effective, relaxed-condition length which is less than the body's nominal width at that same location, whereby the elastomeric strip, at that location, produces a lateral pucker in said body.

4. The structure and system of claim 1, wherein said visibility-enhancing structure takes the form of retro-reflective material.

5. The structure and system of claim 4, wherein said retro-reflective material takes the form of a pair of elongate, retro-reflective tapes joined generally laterally centrally to, and extending along, said opposite faces, generally in the direction of said body's said long axis.

6. The structure and system of claim 1 which further comprises releasable attaching structure joined to said body for receiving, detachably, a secondary identification visibility marker.

7. The structure of claim 1 which further comprises a weight element attached to one end of said body.

8. The structure and system of claim 7, wherein said weight element is a permanent-magnet element.

* * * * *